US006666336B2

(12) United States Patent
Kreft

(10) Patent No.: US 6,666,336 B2
(45) Date of Patent: Dec. 23, 2003

(54) SIEVING DEVICE

(75) Inventor: Manfred Kreft, Nottuln-Darup (DE)

(73) Assignee: Jöst GmbH + Co. KG, Dülmen-Buldern (DE)

( * ) Notice: Subject to any disclaimer, the term of this patent is extended or adjusted under 35 U.S.C. 154(b) by 0 days.

(21) Appl. No.: 09/826,307

(22) Filed: Apr. 5, 2001

(65) Prior Publication Data

US 2001/0040119 A1 Nov. 15, 2001

(30) Foreign Application Priority Data

Apr. 6, 2000 (DE) ..... 100 16 979

(51) Int. Cl.[7] ..... B07B 1/42

(52) U.S. Cl. ..... 209/365.3; 209/329; 209/341; 209/405; 209/921

(58) Field of Search ..... 209/309, 320, 209/322, 325, 326, 329, 364, 365.1, 365.3, 405, 920, 921, 341

(56) References Cited

U.S. PATENT DOCUMENTS 3,647,068 A 3/1972 Wehner
4,469,592 A * 9/1984 Krause et al. ..... 209/367 X
4,632,751 A * 12/1986 Johnson et al. ..... 209/326
4,819,810 A * 4/1989 Hoppe ..... 209/315
5,494,173 A * 2/1996 Deister et al. ..... 209/326

FOREIGN PATENT DOCUMENTS

| | | |
|---|---|---|
| AU | 258791 | 12/1967 |
| DE | 29 18 984 | 1/1981 |
| DE | 35 03 125 C2 | 8/1985 |
| EP | 0 679 448 | 11/1996 |
| RU | 2 059 449 | 5/1996 |
| SU | 328 950 | 7/1970 |
| WO | WO 94/13412 A1 | 6/1994 |

* cited by examiner

*Primary Examiner*—Tuan N. Nguyen
(74) *Attorney, Agent, or Firm*—Nixon Peabody LLP; David S. Safran

(57) ABSTRACT

A sieving device with a vibratory supporting frame and a vibration frame which is held against said supporting frame so as to be able to vibrate freely. A simple, compact design which provides good sieving and conveying performance is achieved in that the vibration frame is spring-elastically coupled to the supporting frame by torsion-bar-like spring elements.

28 Claims, 4 Drawing Sheets

SIEVING DEVICE

BACKGROUND OF THE INVENTION

1. Field of the Invention

The subject matter of the invention is a sieving device with a vibratory supporting frame, with a vibration drive associated with and acting upon the supporting frame, and with a vibration frame held against the supporting frame via spring elements and spring-elastically coupled to the supporting frame, wherein the vibration frame can vibrate at least essentially freely in one direction of vibration (of tension waves), wherein the supporting frame and the vibration frame comprise transverse supports which are alternately arranged one behind the other in the direction of vibration and which, in particular, carry sieve bottom elements which can be tensioned and untensioned in the direction of vibration (of tension waves). Such a sieving device is, in particular, used for materials which are difficult to sieve, such as moist, sticky, caking materials and/or materials containing long fibers.

2. Description of Related Art

German Patent DE 35 03 125 C2 discloses a sieving device comprising a vibratory supporting frame and a vibration frame held to the supporting frame by spring elements so as to be able to vibrate. The transverse supports of the vibration frame extend through window-like apertures in side plates of the supporting frame towards the outside, where the transverse supports are connected to longitudinal supports of the vibration frame. Spring elements, preferably in the form of thrust-type rubber blocks, are arranged at several locations on each longitudinal support in a longitudinal direction, opposing each other in pairs on both sides of a longitudinal support. The thrust-type rubber blocks represent the only bearing arrangement of the vibration frame on the supporting frame, so that the vibration frame can carry out a vibration movement in relation to the supporting frame; said vibration movement being determined by the thrust-type rubber elements and being largely linear. To generate vibration, a vibration drive, which, in particular, is in the form of a withstand vibrations at high amplitude and high frequency even over extended periods. Accordingly, higher acceleration during tensioning of the sieve bottom elements and consequently increased or improved sieving performance, can be achieved. Greater acceleration is also beneficial for conveying the material to be sieved in the sieving direction. This is an additional reason for being able to reduce the inclination of the vibration frame or the direction of vibration in the sieving device according to the invention. When compared to the prior art, a reduction of the inclination of the vibration frame of 3° to 5° relative to the horizontal can be achieved. This results in a correspondingly considerably lower design height.

The provided torsion-bar-like spring elements are significantly less sensitive than thrust-type rubber blocks. In particular, the torsion-bar-like spring elements are virtually temperature-independent, thus providing for more universal application, without there being any danger of overheating. In addition, the service life of torsion-bar-like spring elements is significantly longer than those of thrust-type rubber blocks. Consequently, there is a reduction in the cost of operation and maintenance.

A simple and economic design of the sieving device is made possible in that the vibration frame is exclusively held by the torsion-bar-like spring elements on the supporting frame, so that no additional guiding elements for guiding the vibration frame are necessary.

Even though the main direction of effect of the vibration drive extends transversely as usual to the direction of vibration, in particular, to achieve good conveyance of the material to be sieved in the sieving direction, the spring elements can at least largely prevent interfering vibrations of the vibration frame transverse to the direction of vibration. In this respect, the torsion-bar-like spring elements are superior to the conventional thrust-type rubber elements.

A further aspect of the present invention provides for the sieving device to be operated or to be operable at an increased vibration frequency compared to the prior art, namely at least 850 vibrations per min. and, in particular, at approximately 890 vibrations per min. In this way in particular, an average speed of the vibration frame relative to the supporting frame of preferably at least 11 m/min and an average acceleration of preferably at least 2.2 $m/s^2$ is achieved. In this way, a particularly strong vibration can be achieved which allows more effective sieving. Furthermore, better conveyance of the material to be sieved is achieved in the direction of sieving, so that the inclination of the vibration frame or the vibration can be significantly reduced, in particular, to 3° to 5° to the horizontal. Correspondingly, the required design height of the sieving device can be reduced.

Further details, characteristics, properties, advantages and aims of the present invention are described in the detailed description below and shown in more detail below by means of the drawing of the preferred embodiments.

DETAILED DESCRIPTION OF THE INVENTION

FIGS. 1 to 4 show a proposed sieving device 1; two somewhat different embodiments of which are shown and will be explained in detail below.

Figure 3:
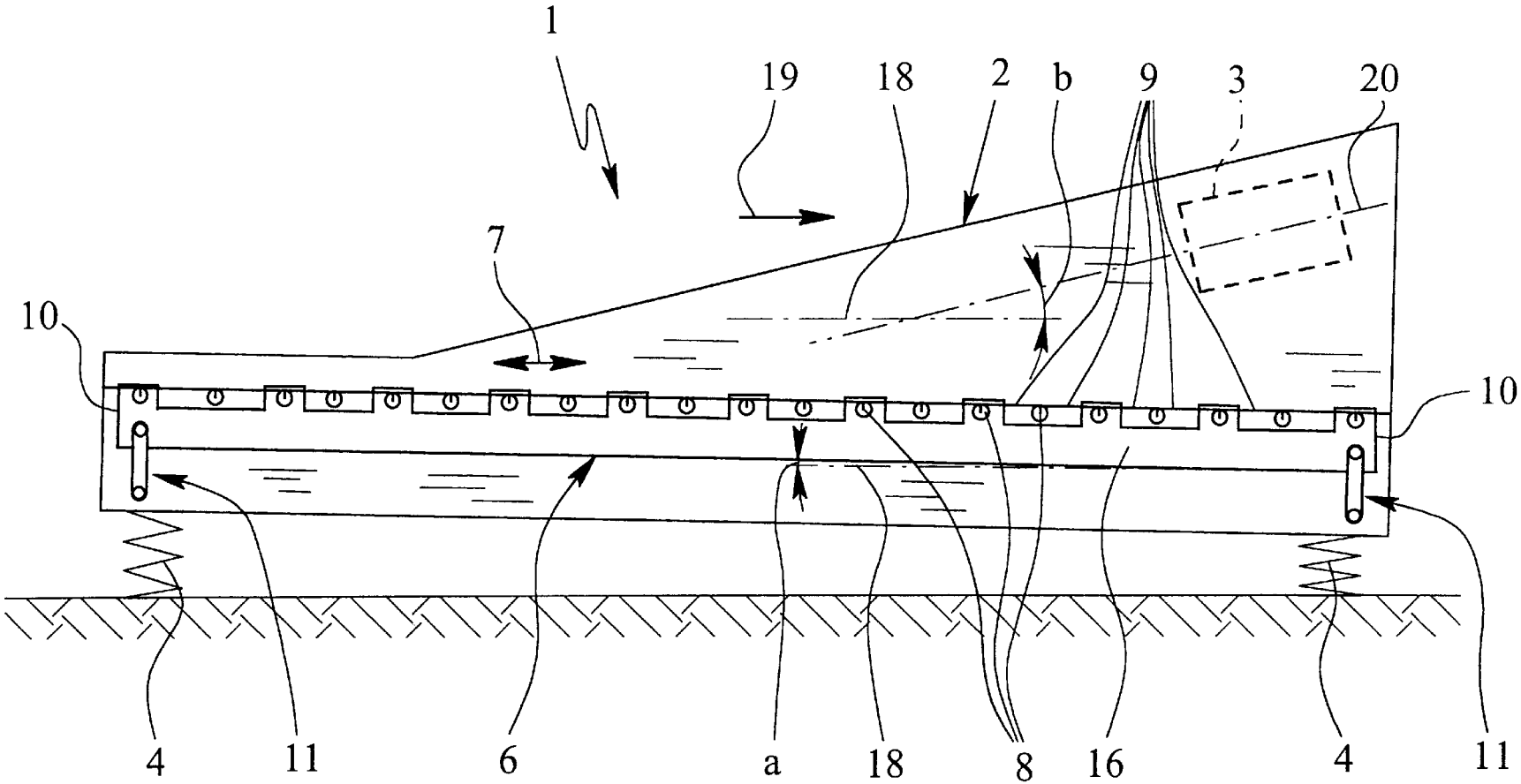
FIG. 3 is a diagrammatic longitudinal section of a somewhat modified embodiment of the sieving device.

The sieving device 1 comprises a vibratory supporting frame 2 which is vibrated by means of an associated vibration drive 3 indicated by a dashed line in FIG. 3. In particular, the vibration drive 3 is connected to the supporting frame 2 or is held by said supporting frame 2. The vibration drive 3 can, in particular, be an unbalanced motor, directional vibration drive or circular vibration drive. In particular, the vibration drive 3 is a linear vibration drive, i.e., at least essentially only linear vibrations are generated.

Figure 2:
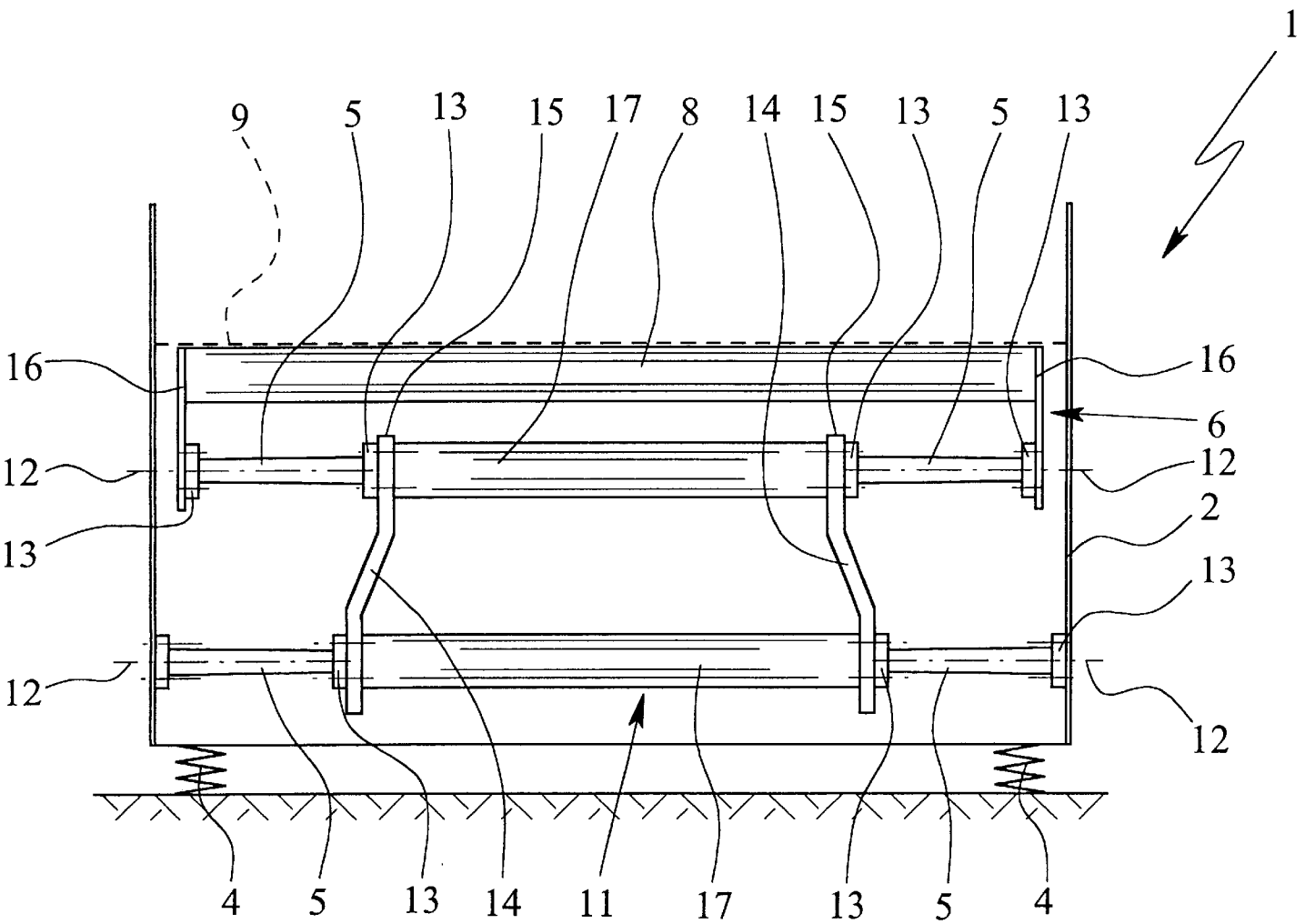
FIG. 2 is a diagrammatic lateral view of the sieving device according to FIG. 1.

The supporting frame 2 is held in such a way that the supporting frame 2 can vibrate. In the embodiments shown the supporting frame 2 is held to this effect by support springs 4 (diagrammatically shown) and, in particular, is installed on said support springs 4 as shown in FIGS. 2 & 3.

On the supporting frame 2, spring elements 5 are supported by way of a vibration frame 6 which is spring-elastically coupled to the supporting frame 2. At the same time, the spring elements 5 hold or guide the vibration frame 6, thus obviating the need for additional guiding elements or the like to connect the vibration frame 6 to the supporting frame 2.

The vibration frame 6 is held to the supporting frame 2 such that the vibration frame 6 can freely move back and forth essentially at least in one direction 7 of vibration (of tension waves), i.e., the vibration frame 6 is not compulsorily controlled, but instead, the vibration frame 6 is under the influence of the spring elements 5, so as to carry out vibration which, in this discolsure, is also called "vibration of tension waves." Preferably, the vibration frame 6 can at least essentially vibrate exclusively in the main direction 7 of vibration.

Figure 1:
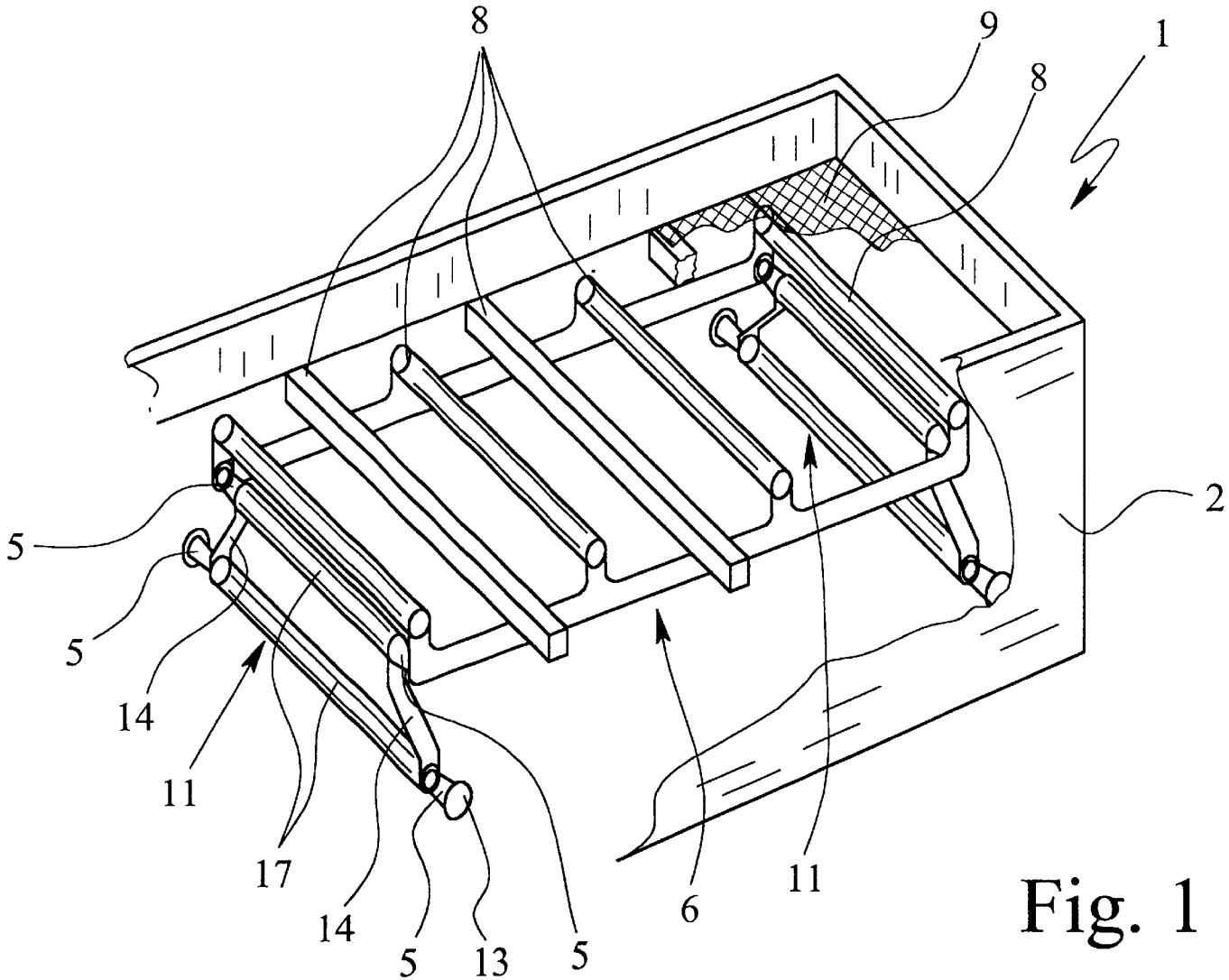
FIG. 1 is a diagrammatic perspective partial view of a sieving device.
Figure 4:
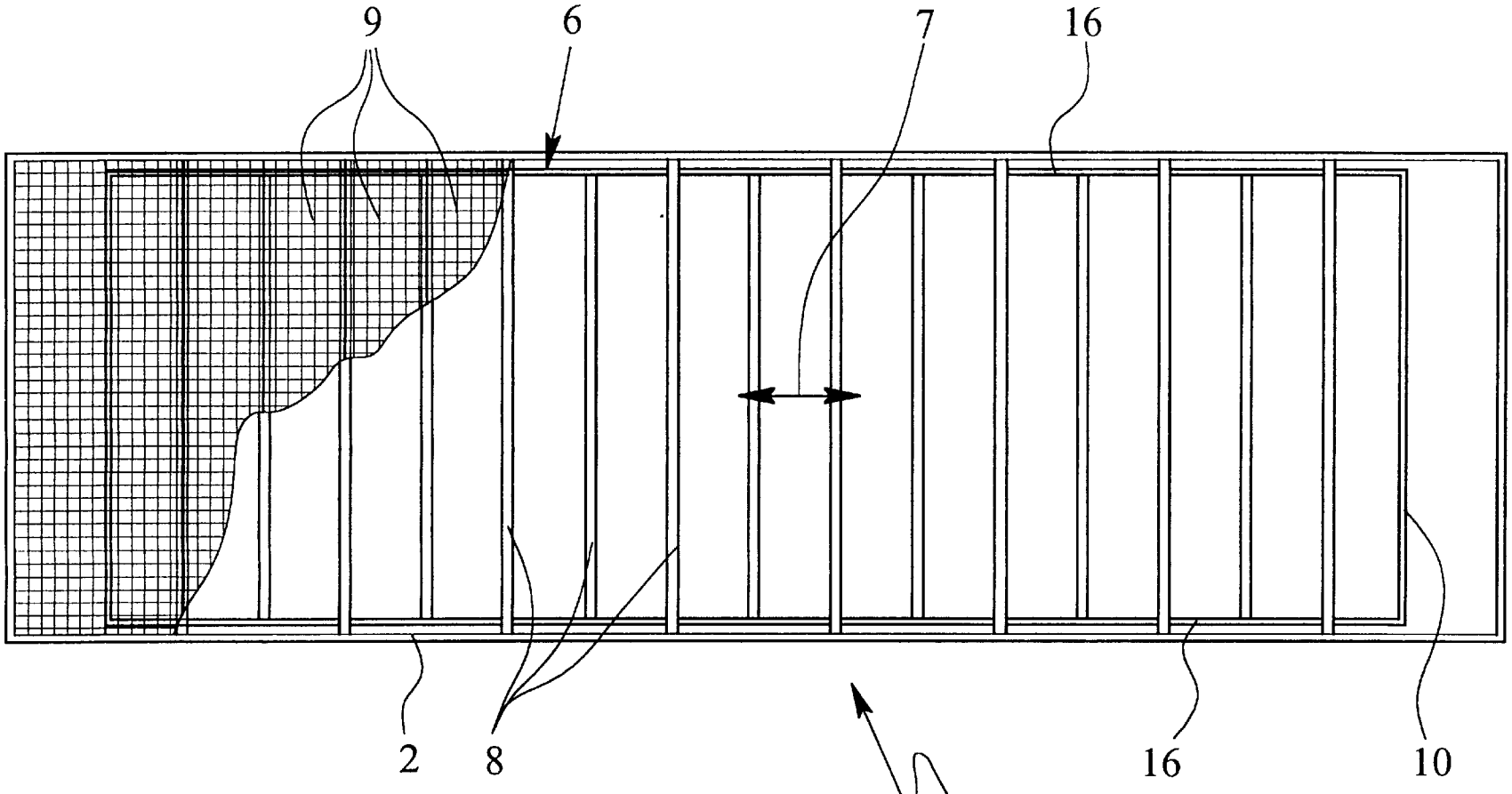
FIG. 4 is a simplified top view of the sieving device according to FIG. 3.

FIGS. 1, 3 and 4 show that transverse supports 8 are arranged at or supported by the supporting frame 2 and at the vibration frame 6. The transverse supports 8 extend at least essentially horizontally and transversely to the direction 7 of vibration. The transverse supports 8 are arranged one behind the other in the direction 7 of vibration, at least essentially in one plane. The transverse supports 8 are alternately supported either by the supporting frame 2 or by the vibration frame 6. If the vibration frame 6 vibrates back and forth in the direction 7 of vibration, the spacing between adjacent transverse supports 8 is accordingly increased and decreased alternately. This causes the sieve (bottom) elements (mats or screens) 9, which are supported by the transverse supports 8 and which preferably extend from one transverse support 8 to the next, to be tensioned and untensioned alternately. This results in high acceleration of material to be sieved which is located on the sieve bottom elements 9 (not shown) so that even material which is difficult to sieve can be sieved or classified.

The sieve bottom elements or sieve bottom mats or screens 9 are, in particular, individually exchangeable and are made so as to be sufficiently flexible, as is generally known from the prior art.

In the embodiment according to FIG. 1, the vibration frame 6 comprises four transverse supports 8; said vibration frame 6 in the region of its ends or transverse sides 10 being held to the supporting frame 2 by the spring elements 5, so as to be able to vibrate. The spring elements 5 form bearing subassemblies 11 for the vibration frame 6 whose design will be explained in detail below. In the embodiment according to FIG. 1, each bearing subassembly 11 is arranged in the region of a transverse side 10 of the vibration frame 6. Thus, the vibration frame 6 is coupled to the supporting frame 2 only by way of two bearing subassemblies 11. In this way, the vibration frame 6 is spring-elastically coupled so as to carry out vibration of the tension waves. The bearing subassemblies 11 can, however, also be arranged inwardly from the transverse sides 10.

The sieving device 1 can comprise several short vibration frames 6 with respectively two bearing subassemblies 11, wherein the vibration frames 6 are arranged one behind another and are coupled to the same supporting frame 2.

The sieving device 1 can, however, also comprise a "longer" vibration frame 2, i.e., one comprising an increased number of transverse supports 8, as is the case in the embodiments according to FIGS. 3 and 4. In this embodiment too, the vibration frame 6 is, for example, again supported by the supporting frame 2 only by two bearing subassemblies 11 and held so as to be able to vibrate. However, more than two bearing subassemblies 11 can be provided. In particular if required, for example, every transverse support 8 or every second transverse support 8 of the vibration frame 6 can be associated with a bearing subassembly 11 for holding the vibration frame 6. This makes it possible to use identical bearing subassemblies 11 for various sieving devices 1 with vibration frames 6 of different length.

Below, the preferred design of a bearing subassembly 11 is explained in more detail.

FIGS. 1 and 2 show that in each instance two spring elements 5 of a bearing subassembly 11 are connected to the supporting frame 2, i.e. on opposite longitudinal or side plates or longitudinal sides of the supporting frame 2, with their longitudinal axes which correspond to torsion axes 12 being coaxially aligned. These two spring elements 5 are attached to the supporting frame 2 so as to oppose each other.

To simplify the attachment on the ends or to simplify fixing of the spring elements 5, attachment flanges 13 are preferably incorporated in a single piece in the attachment ends of the spring elements 5. The attachment flanges 13, for example, comprise respective recesses or through-holes on the margin-side, so that said attachment flanges 13 can, in particular, be connected to adjacent components by means of screw connections (not shown).

The spring elements 5 are made preferably from solid steel.

In order to achieve ideal spring behavior of the spring elements 5, i.e. the desired spring constant of torsion around the torsion axes 12 as well as adequate spring hardness and load resistance in relation to the support load of the spring elements 5 transversely to the torsion axes 12 and, in particular, in vertical direction, along the lengths of the spring elements 5, the cross-section is preferably variable. For example, the cross section may be smallest in the middle. In particular, the spring elements 5 (of course without taking into account the attachment flanges 13) are at least slightly conical, as suggested in FIG. 2 (not to scale). In this case, the ends with the larger cross section of the two spring elements 5 are preferably connected to the supporting frame 2 by means of the attachment flanges 13.

At the free ends of the spring elements 5 attached to the supporting frame 2 where the free ends are facing each other, swinging arms 14 are provided which are connected to the spring elements 5, in particular, via the respective attachment flanges 13, with said swinging arms 14 transversely or radially protruding from the longitudinal axis or the torsion axes 12 of these two spring elements 5. The swinging arms 14 extend at least essentially and at least in their neutral position, i.e. in their unstressed state, perpendicularly to the direction 7 of vibration towards the vibration frame 6. In the shown and preferred embodiment, the bearing subassembly 11 is at least essentially arranged between the vibration frame 6 and below the vibration frame 6. Accordingly, the swinging arms 14 at least essentially extend vertically upward towards the vibration frame 6. However, other constructions are, of course, also possible.

At the ends 15 of the swinging arms 14 facing the vibration frame 6, the swinging arms 14 are pivotably connected or connected via articulation, to the vibration frame 6, in particular, to longitudinal supports 16 of the vibration frame 6. A pivotable connection to the vibration frame 6 is again achieved by means of spring elements 5. However, the region of the ends 15 of the swinging arms 14 could also be connected to the vibration frame 6 via a pivot bearing arrangement or the like (not shown).

According to the preferred embodiments, the spring elements 5 which couple the swinging arms 14 to the vibration frame 6, are of the same design as the spring elements 5 which couple the swinging arms 14 to the supporting frame 2.

As an alternative, the "lower" spring elements 5 which are connected to the supporting frame 2, can be substituted by the above mentioned pivot bearing arrangement or the like, provided the spring hardness of the remaining "upper" spring elements 5 which are connected to the vibration frame 6 is adequate for achieving the desired vibration behavior of the sieving device 1.

The "thicker" ends, i.e., the ends with the larger cross section, of the spring elements 5 are connected to the associated swinging arm 14 in the region of the end 15 of said swinging arm 14, extending in pairs with coaxial torsion axes 12 away from each other towards the vibration frame 6 where the spring elements 5 with their "thinner" ends are connected via their attachment flanges 13 to the vibration frame 6 or its longitudinal supports 16.

In the embodiments shown, the width of the vibration frame 6 is narrower than that of the supporting frame 2, i.e., the vibration frame is arranged in the supporting frame. Nevertheless, to be able to use a uniform spring element 5 or spring elements 5 with the same length, the difference in width can be compensated for by respective spacers, shims or the like (not shown). Preferably however, the swinging arms 14 are offset by a double-kink or double-bend, as shown in FIG. 2, so as to compensate for the above-mentioned difference in width.

In the preferred embodiments, all spring elements 5 of a bearing subassembly 11 and, in particular, all spring elements 5 of all bearing subassemblies 11, extend at least essentially parallel in relation to each other, with the spring elements 5 being arranged coaxially in pairs and mutually spaced apart.

The two swinging arms 14 of a bearing subassembly 11 are preferably interconnected via at least a torsionally rigid and, in particular, a tubular connection element 11. Depending on the construction, the connection element 11 can also directly engage the associated spring elements 5 or their attachment flanges 13, thus interconnecting two spring elements 5 with coaxial torsion axes 12. In the latter case, the swinging arms 14 are firmly connected to the connection element 17.

Preferably, two connection elements 17 have been provided which essentially extend between the upper spring elements 5 and the lower spring elements 5 of one bearing subassembly 11 thus forming, with the swinging arms 14, a trapezoid stiffening element which is connected via spring elements 5 not only to the supporting frame 2 but also to the vibration frame 6.

Preferably, the connection elements 17 are screwed to the swinging arms 14, for example, the screws or threaded bolts are screwed from spring elements 5 and corresponding sections of the swinging arms 14 through associated attachment flanges 13 into the connection elements 17. This makes a simple installation and simple exchange of components possible, if required. For example, the swinging arms 14 and the connection elements 17 can also be welded together or connected in some other way.

The stiffening caused by the connection elements 17 ensures that the support characteristics (load in vertical direction) and the spring characteristics (torsion of the spring elements 5 for the movement of vibration of the vibration frame 6) of a bearing subassembly 11 are largely the same on both sides with regard to the longitudinal axis of the sieving device 1. This results in symmetrical vibration behavior of the vibration frame 6 and the sieving device 1 in relation to their longitudinal axes, while preventing any rotary vibration of the vibration frame 6 around its longitudinal axis.

The above-mentioned spring-elastic support and guidance of the vibration frame 6 exclusively, by means of the spring elements 5 and swinging arms 14 or similarly held by said spring elements 5, ensures a simple and economical design.

The above-mentioned bearing subassemblies 11 provide simple and effective guidance of the vibration frame 6, with the vibration frame 6 being movable back and forth in the direction 7 of vibration of the tension waves relatively easily or at least adequately easily. Due to the torsion of the spring elements 5 during vibration, the vibration frame 6, strictly speaking, does not carry out any straight-line or linear vibration movements, but instead the vibration frame 6 moves back and forth along a slightly curved orbit. However, since the excursion or vibration amplitude is relatively slight, in particular, approximately ±3.2 to 3.5 mm, the vibration movement can be regarded as being at least essentially linear. Furthermore, tests have shown that such movement of vibration results in very effective sieving.

The sieving device 1 according to the illustrated embodiments provides a particular advantage in that vibration absorption of the vibration frame 6 relative to the supporting frame 2 is relatively slight, so that relatively little absorption effort needs to be expended during operation, and unnecessary heating of the moving or elastically deforming components in particular, of the spring elements 5, is avoided.

In the embodiments shown, the vibration frame 6 is arranged at least essentially within the supporting frame 2. In particular, the longitudinal supports 16 of the vibration frame 6 are arranged on the inside of lateral side plates of the supporting frame 2. This allows a simple design because the transverse supports 8 of the vibration frame 6 do not penetrate the side plates of the supporting frame 2. Of course, other embodiments are also possible.

In the embodiment shown in FIGS. 3 & 4, the direction 7 of vibration or the plane of the main direction of extension of the vibration frame 6, is inclined to the horizontal 18 by an angle a in the sieving direction 19, i.e., in the direction in which the material to be sieved is transported or conveyed over the sieve bottom elements 9, provided said material does not fall through the sieve bottom elements 9. Preferably, the angle of inclination a is approximately 3° to 5°. This is a surprisingly shallow angle, but this angle is sufficient in the sieving device 1 according to the illustrated embodiment for conveyance in the sieving direction 19.

The main direction of vibration 20 of the vibration effected on the supporting frame 2 by the vibration drive 3 is against the sieving direction 19, and inclined to the horizontal 18 by an angle b. In this case, the angle of inclination b is preferably between 30° and 50°, in particular, essentially 40°.

Preferably, the sieving device 1 is designed such that the resonance frequency is at least 1,100 vibrations per minute and, in particular, at least 1,200 vibrations per minute. This allows sub-critical operation of the sieving device 1, i.e. vibration below the resonance frequency at a significantly higher vibration frequency compared to the prior art.

The sieving device 1 according to the proposal is preferably designed such that the sieving device 1 can be operated at a vibration frequency of at least 850 vibrations per minute and, in particular, essentially at 890 vibrations per minute or higher. The vibration drive 3 is designed accordingly. The vibration frame 6 then carries out vibration of the tension waves in the direction 7 of vibration of tension waves. The amplitude is, in particular, approximately ±3.2 to 3.5 mm. In this way, an average speed of the vibration frame 6 relative to the supporting frame 2 in excess of 11 m/min and an average acceleration of at least 2.2 $m/s^2$ can be achieved. In this way, vibration of the tension waves can be achieved which is considerably improved when compared to the prior art; such improved vibration resulting in a correspondingly more effective sieving and improved conveyance of material to be sieved in the sieving direction 19.

In vertical and horizontal direction, the spring elements 5 act as bending springs. The intrinsic frequency of the vibration system in these directions is far above the drive frequency. Accordingly, quasi-nonresonant vibrations occur in these directions.

The torsion-bar-like spring elements 5 are characterised by a very great capacity for storing energy. For this reason, a relatively large mass can be moved with relatively few spring elements 5, with no absorption taking place in comparison to thrust-type rubber elements, and with the frequency range not being significantly limited or altered as a result of inherent heating or other influences such as temperature and aging. Adaptation to any given condition can easily take place by varying the diameter and/or the length of the spring elements 5.

The use of torsion-bar-like spring elements 5 leaves the choice of vibration parameters and size of the sieving device 1 completely open. Thus, there is increased freedom of design when compared to the state of the art.

What is claimed is:

1. A sieving device comprising:

a vibratory supporting frame, a vibration drive acting upon said supporting frame, and a vibration frame spring-elastically coupled to said supporting frame via spring elements, wherein said vibration frame can vibrate essentially freely in one direction of vibration, wherein said supporting frame and said vibration frame comprise transverse supports which are alternately arranged one behind the other in a direction of vibration, and which are adapted to carry sieve bottom elements which can be tensioned and untensioned in the direction of vibration, and wherein said spring elements are torsion-bar springs, and swinging arms are connected to said spring elements and protrude transversely relative to a longitudinal axis and a torsion axis of said spring elements, the swinging arms being coupled said vibration frame to said supporting frame.

2. The sieving device according to claim 1, wherein said vibration frame is exclusively connected to or coupled with said supporting frame via said spring elements.

3. The sieving device according to claim 1, wherein said spring elements respectively extend essentially in one direction.

4. The sieving device according to claim 1, wherein longitudinal axes of said spring elements correspond to torsion axes of said spring elements.

5. The sieving device according to claim 1, wherein torsion axes of said spring elements are aligned so as to be essentially perpendicular to the direction of vibration.

6. The sieving device according to claim 5, wherein torsion axes of said spring elements are aligned so as to be essentially parallel to a main direction of extension of the transverse supports.

7. The sieving device according to claim 1, wherein said spring elements are made from solid material.

8. The sieving device according to claim 1, wherein a cross section of said spring elements varies along longitudinal axes of said spring elements and the cross section is conical.

9. The sieving device according to claim 1, wherein at least one end of each spring element comprises a one piece attachment flange.

10. The sieving device according to claim 9, wherein both ends of each spring element comprise a one piece attachment flange.

11. The sieving device according to claim 1, wherein said vibration frame is held against said supporting frame via at least two bearing subassemblies including said spring elements.

12. The sieving device according to claim 1, wherein each swinging arm is connected via one of said spring elements to said supporting frame and via another of said spring elements to said vibration frame.

13. The sieving device according to claim 1, wherein one of said spring elements connected to said supporting frame is respectively connected to a further one of said spring elements via a swinging arm.

14. The sieving device according to claim 1, wherein opposite ends of each of said swinging arms are offset relative to each other.

15. The sieving device according to claim 12, wherein opposite ends of each of said swinging arms are offset relative to each other.

16. The sieving device according to claim 13, wherein opposite ends of each of said swinging arms are offset relative to each other.

17. The sieving device according to claim 1, wherein said spring elements are arranged coaxially in pairs.

18. The sieving device according to claim 17, wherein a torsionally rigid connection element is arranged between one or all of said pairs of spring elements and connects said respective two spring elements.

19. The sieving device according to claim 1, wherein a torsionally rigid connection element is arranged connecting said swinging arms connected to said respective spring elements.

20. The sieving device according to claim 1, wherein said spring elements are arranged in the region of two transverse sides of said vibration frame.

21. The sieving device according to claim 1, wherein said spring elements are arranged within said supporting frame.

22. The sieving device according to claim 1, wherein said vibration frame is arranged essentially within said supporting frame.

23. The sieving device according to claim 1, wherein said spring elements are formed by solid torsion bars.

24. The sieving device according to claim 1, wherein a main direction of extension of the vibration frame is inclined at an angle relative to horizontal in a direction in which the material to be sieved moves over the sieve bottom elements.

25. The sieving device according to claim 24, wherein said angle is approximately 3° to 5°.

26. The sieving device according to claim 1, wherein the vibration drive extends in a main direction of vibration of the supporting frame which is counter to a direction in which the material to be sieved moves over the sieve bottom elements, and is inclined at an angle relative to horizontal.

27. The sieving device according to claim 26, wherein aid angle is between 30° and 50°.

28. A sieving device comprising:

a vibratory supporting frame, a vibration drive acting upon said supporting frame, and a vibration frame held spring-elastically coupled to said supporting frame via spring elements, wherein said vibration frame can vibrate essentially freely in one direction of vibration, wherein said supporting frame and said vibration frame comprise transverse supports which are alternately arranged one behind the other in a direction of vibration, and which are adapted to carry sieve bottom elements which can be tensioned and untensioned in the direction of vibration, and wherein said vibration frame is supported relative to said supporting frame via at least two bearing subassemblies which include said spring elements, and swinging arms are connected to said spring elements and protrude transversely relative to a longitudinal axis and a torsion axis of said spring elements, the swinging arms being coupled said vibration frame to said supporting frame.

* * * * *